US006896197B2

(12) United States Patent
Rochat et al.

(10) Patent No.: US 6,896,197 B2
(45) Date of Patent: May 24, 2005

(54) ABRASIVE BLASTING APPARATUS

(75) Inventors: Pierre Rochat, Geneva (CH); Michel Parnia, Mont sur Lausanne (CH)

(73) Assignee: EXA SA, Mon sur Lausanne (CH)

( * ) Notice: Subject to any disclaimer, the term of this patent is extended or adjusted under 35 U.S.C. 154(b) by 0 days.

(21) Appl. No.: 10/114,293

(22) Filed: Apr. 2, 2002

(65) Prior Publication Data

US 2002/0175219 A1 Nov. 28, 2002

Related U.S. Application Data

(63) Continuation of application No. PCT/EP00/09960, filed on Oct. 10, 2000.

(30) Foreign Application Priority Data

Oct. 13, 1999 (GB) ..... 99240095

(51) Int. Cl.[7] ..... A01G 27/00; B05B 9/00; A62C 31/00

(52) U.S. Cl. ..... 239/69; 239/61; 239/67; 239/142; 239/398

(58) Field of Search ..... 239/61, 69, 67, 239/74, 68, 142, 124, 650, 683, 146, 147, 149, 172, 722, 398, 436, 596; 137/870, 887

(56) References Cited

U.S. PATENT DOCUMENTS 3,758,004 A * 9/1973 Garrett et al. ..... 222/231
4,106,964 A * 8/1978 DeVittorio ..... 156/75
4,562,791 A * 1/1986 Porter et al. ..... 118/326
4,741,130 A * 5/1988 Tano et al. ..... 451/38
5,320,289 A 6/1994 Craigen et al.
5,361,711 A * 11/1994 Beyerl ..... 111/127
5,405,254 A * 4/1995 Hennessy et al. ..... 418/61.3
5,800,246 A * 9/1998 Tomioka ..... 451/2
5,904,296 A * 5/1999 Doherty et al. ..... 239/61

FOREIGN PATENT DOCUMENTS

| | | |
|---|---|---|
| DE | 42 09 552 | 9/1993 |
| DE | 197 38 572 | 3/1999 |
| EP | 0 706 858 | 4/1996 |
| WO | WO 91 04449 | 4/1991 |

* cited by examiner

*Primary Examiner*—Davis Hwu
(74) *Attorney, Agent, or Firm*—Strum & Fix LLP

(57) ABSTRACT

An abrasive blasting system (100) having provision (190, 400) for its operating parameters to be automatically set to optimum values. A "smart" container (200) having a built-in dispensing system (204) is pre-loaded at a depot with an abrasive powder suitable for a particular task under certain conditions, and the appropriate operational parameters for the blasting system (100) are programmed into a storage and transmission system (290) forming part of the "smart" container (200). When the "smart" container (200) is coupled to the abrasive blasting system (100), the stored operational parameters are transmitted to a reception system (190) which causes the parameter setting system (400) to set the operating parameters without operator intervention.

20 Claims, 8 Drawing Sheets

ABRASIVE BLASTING APPARATUS

CROSS REFERENCE TO RELATED APPLICATIONS

This application is a Continuation application of PCT/EP00/09960 filed Oct. 10, 2000, which claimed priority of Great Britain Application No. 99240095.4 filed Oct. 13, 1999, entitled "Abrasive Blasting Apparatus" all of which are including in their entirety by reference made hereto.

BACKGROUND OF THE INVENTION 1. Field of the Invention

This invention relates to abrasive blasting with particulate material, and relates more particularly but not exclusively to systems and equipment for abrasive blasting, and to subsystems and apparatus therefor.

2. Description of the Prior Art

The cleaning of surfaces by abrasive blasting is a well known procedure, involving the hurling of particulate material against the surface either by mechanical means, or by entraining the particulate material in a jet of air directed at the surface. The particulate material is more or less abrasive, and may be in the form of metal shot, sand or any other suitable material. The particulate material may be coarse (e.g. gravel-like), fine (e.g. a powder), or smooth (e.g. beads). The impact of the particulate abrasive material on the surface to be cleaned tends to abrade and remove surface contamination (e.g. dirt), and may even remove part of the surface itself.

Practical advantages of abrasive blasting as a surface cleaning process have led to attempted extension of the process to cleaning of surfaces previously cleaned by other methods, or which were left uncleaned. However, abrasive blasting systems which are good at cleaning the surfaces of metal castings (for example) may prove unsuitable for cleaning more delicate surfaces, such as mediaeval stonework. Success in the application of abrasive blasting to cleaning or otherwise treating surfaces presenting special problems requires care in selection of abrasive material, its feed rate, transport velocity and other parameters defining the abrasive process. Reduction or elimination of the possibility of operator error is also highly desirable, that is it should ideally be difficult or impossible for the operator to use the abrasive cleaning equipment in a manner which (for example) results in unnecessary damage to the surface being cleaned, and in excessive consumption of abrasive material.

BRIEF SUMMARY OF THE INVENTION

According to a first aspect of the present invention there is provided a supply and control system for holding a particulate material and for co-operating with an apparatus utilising particulate material initially held in the supply and control system, the supply and control system comprising container means for holding the particulate material, dispensing means for controllably dispensing particulate material from the container means, coupling means for coupling the supply and control system to the apparatus, and operational parameter storage and transmission means for storing predetermined operational parameters for the apparatus and for transmitting these stored operational parameters to the apparatus when the supply and control system is coupled thereto.

According to a second aspect of the present invention, there is provided an apparatus for utilising particulate material initially held in a supply and control system according to the first aspect of the present invention, wherein the apparatus comprises a mixing chamber, operational parameter reception means, and coupling means for coupling a supply and control system according to the first aspect of the present invention to the apparatus.

BRIEF DESCRIPTION OF THE DRAWINGS

Embodiments of the invention will now be described by way of example, with reference to the accompanying drawings wherein.

DETAILED DESCRIPTION OF THE INVENTION

Figure 1:
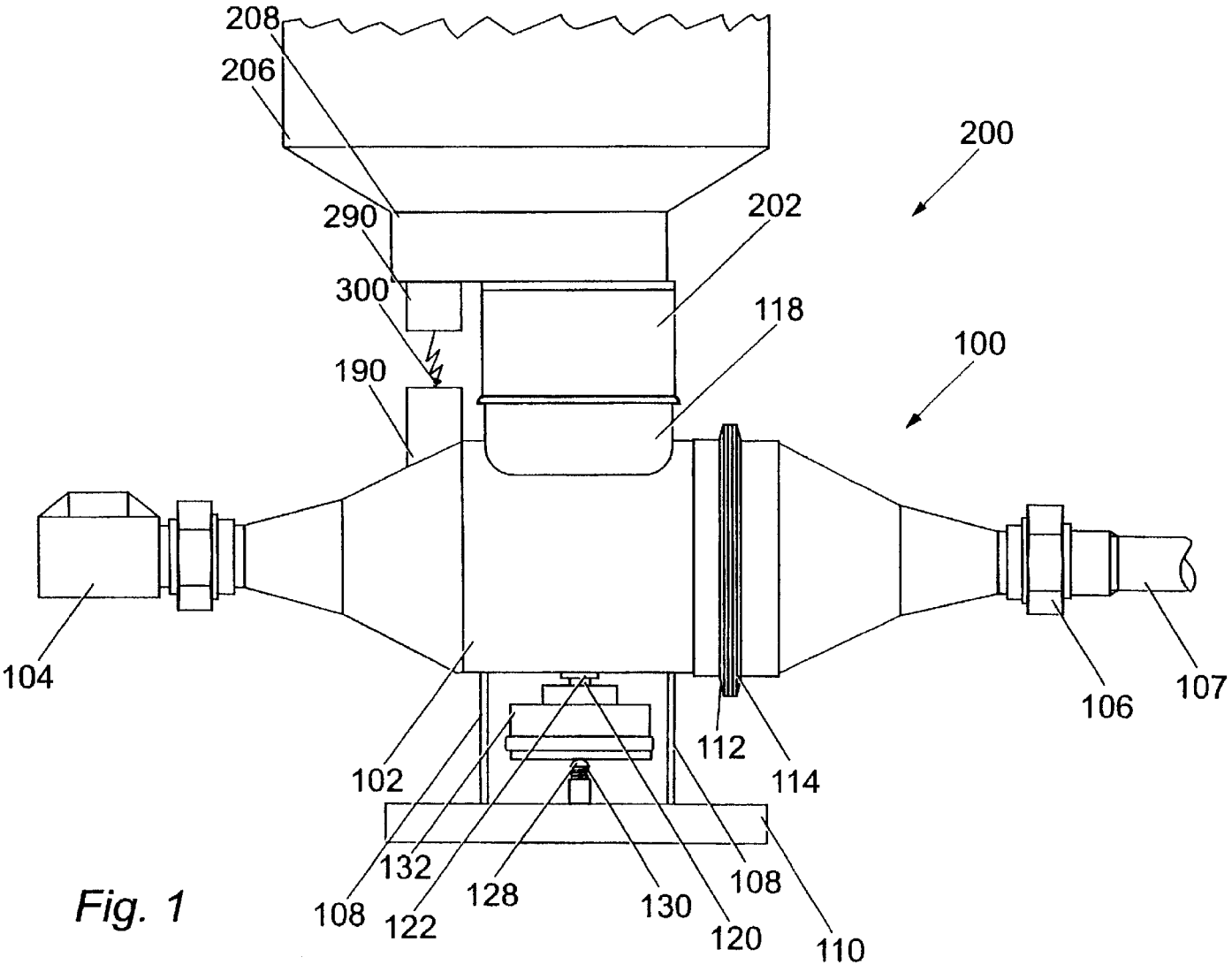
FIG. 1 is a side elevation of a preferred embodiment of abrasive blasting system in accordance with the invention, coupled to a preferred embodiment of supply and control system, also in accordance with the invention.

Referring first to FIG. 1, this shows a side elevation of the principal parts of an abrasive blasting system 100 having a supply and control system 200 (shown incompletely) coupled to it. The abrasive blasting system 100 comprises a mixing chamber 102 fed from above with particulate material (as will be detailed subsequently) and fed from the left with compressed air by way of an inlet connector 104. A high-pressure stream of airborne particulate material leaves the right end of the mixing chamber 102 by way of a hose coupling 106, a flexible hose 107, and an operator-held nozzle (not shown) used to control the direction of the abrasive blast, and its distance from the surface being treated.

The mixing chamber 102, and the abrasive blasting system 100 as a whole, is mounted on supports 108 carried by a foundation member 110. The right end of the mixing chamber 102 is detachable to allow internal access for cleaning and other maintenance, and is normally held in place by a ring clamp (not shown) fitted around a pair of tapered flanges 112 and 114. An O-ring 116 (FIG. 2) is fitted between the flanges 112 and 114 to render the joint air-tight.

A circular male coupling 118 (FIGS. 1, 2 and 3) is welded to the top of the mixing chamber 102 for the attachment of the supply and control system 200 by way of a female coupling 202.

A vertical shaft 120 is rotatably mounted through the centre of the mixing chamber 102 on lower and upper bushes 122 and 124. The shaft 120 is surrounded by an air-tight housing 126 where it passes through the mixing chamber 102. The shaft 120 is vertically supported at its lower end by a vertically slidable dome-headed pin 128 urged upwards by a coiled compression spring 130, the pin 128 and the spring 130 being mounted in the centre of the foundation member 110. A pulley 132 is fitted on the lower end of the shaft 120 as part of a double-reduction belt drive 134 (FIG. 3) driven by a pneumatic motor (not shown in FIGS. 1–4, but shown in FIG. 14). The top end of the shaft 120 is fitted with a plug-in shaft coupling socket 136 for rotary connection to a dispensing unit 204 forming part of the supply and control system 200.

Figure 2:
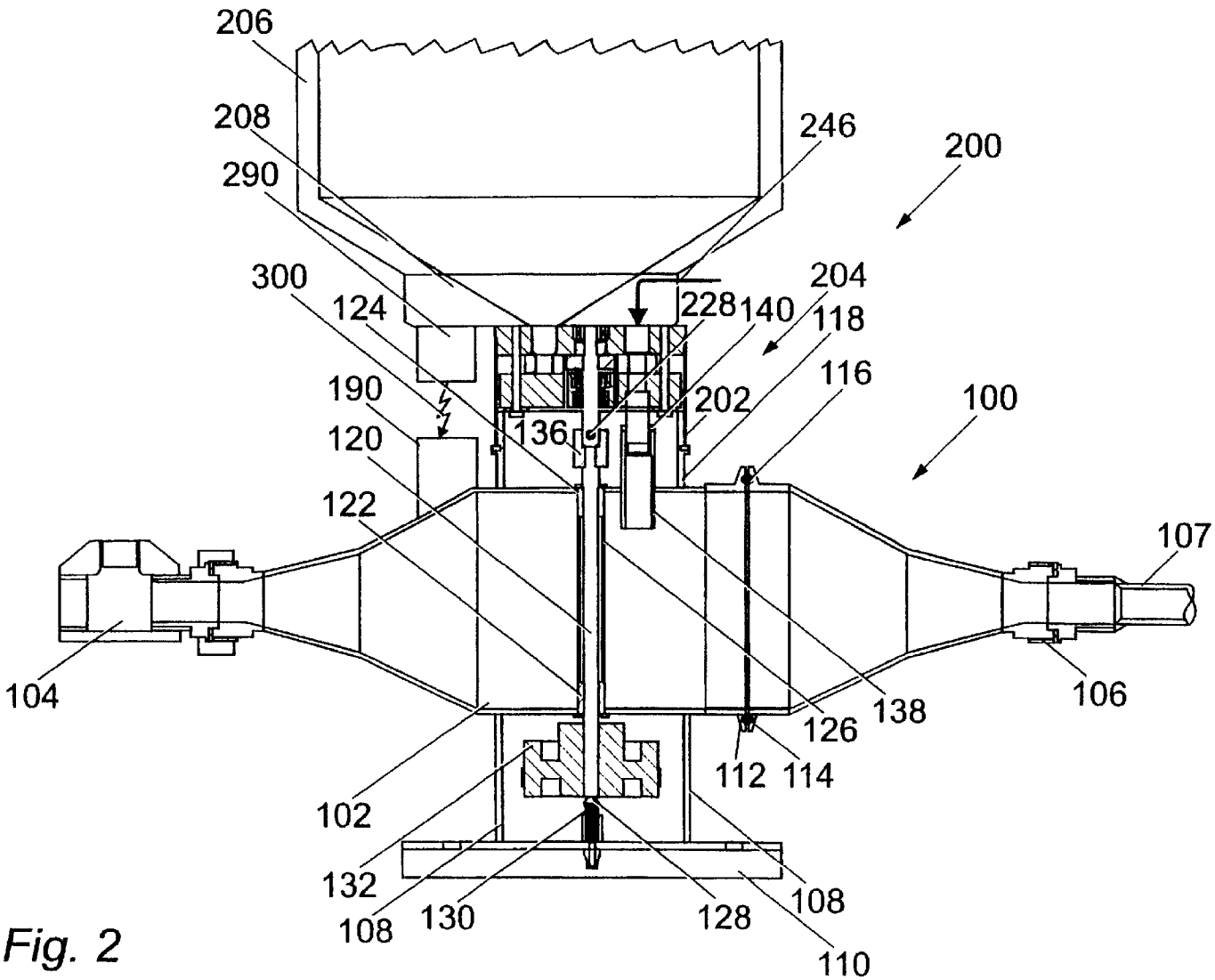
FIG. 2 is a sectional elevation of the arrangement of FIG. 1.
Figure 3:
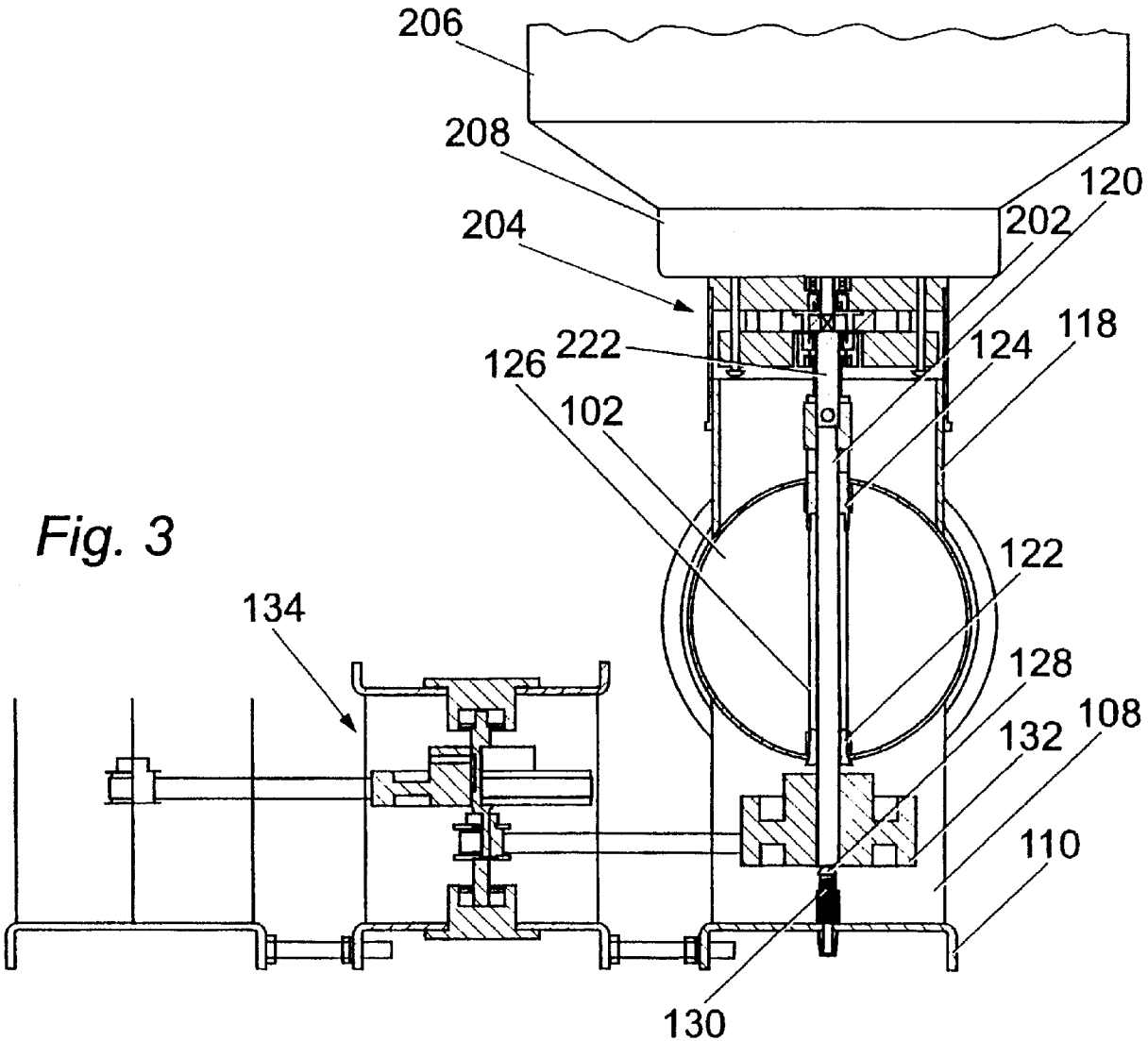
FIG. 3 is a sectional end elevation of the arrangement of FIG. 1.

The supply and control system 200 has the general form of a container 206 (shown incomplete) with the dispensing unit 204 mounted on the container's neck flange 208. The supply and control system 200 is stored upright when separate from the abrasive blasting system 100, and inverted for coupling to the system 100 as shown in FIGS. 1–3.

The dispensing unit 204 (see FIGS. 2, 3 and especially FIG. 4), comprises a fixed upper plate 210, a fixed lower plate 212, and a rotor disc 214 sandwiched between the plates 210 and 212. The plates 210 and 212 are mutually secured by screws 216. The coupling 202 is an interference fit on the periphery of the upper plate 210.

The upper and lower plates 210 and 212 have respective central bearings 218 and 220 which rotatably support a shaft 222 whose lower end extends below the lower plate 212. The shaft 222 is keyed to the rotor disc 214 such that rotation of the shaft 222 causes matching rotation of the rotor disc 214. (The screws 216 are not so tight that the rotor disc 214 is prevented from rotating). The upper and lower plates 210 and 212 also have respective shaft seals 224 and 226 which protect the bearings 218 and 220 against abrasive material. The lower end of the shaft 222 is provided with a shaft coupling 228 which automatically plugs into the shaft coupling socket 136 (FIGS. 2 and 3) when the supply and control unit 200 is mounted on top of the abrasive blasting system 100. This ensures that rotation of the shaft 120 causes matching rotation of the shaft 222 and of the rotor disc 214.

The container neck flange 208 is fitted with an inverted cone 230 which deflects particulate material flowing from the interior of the container 206 to the container outlet 232, the cone 230 helping to maintain constant pressure of particulate material at the outlet 232. An upward extension (not shown) of the shaft 222 couples to a rotatable paddle (not shown) or other suitable agitator mounted within the container 206 so as to agitate particulate material within the container 206 in order to discourage caking or bridging that would otherwise inhibit free flow of particulate material through the outlet port 232.

Figure 4:
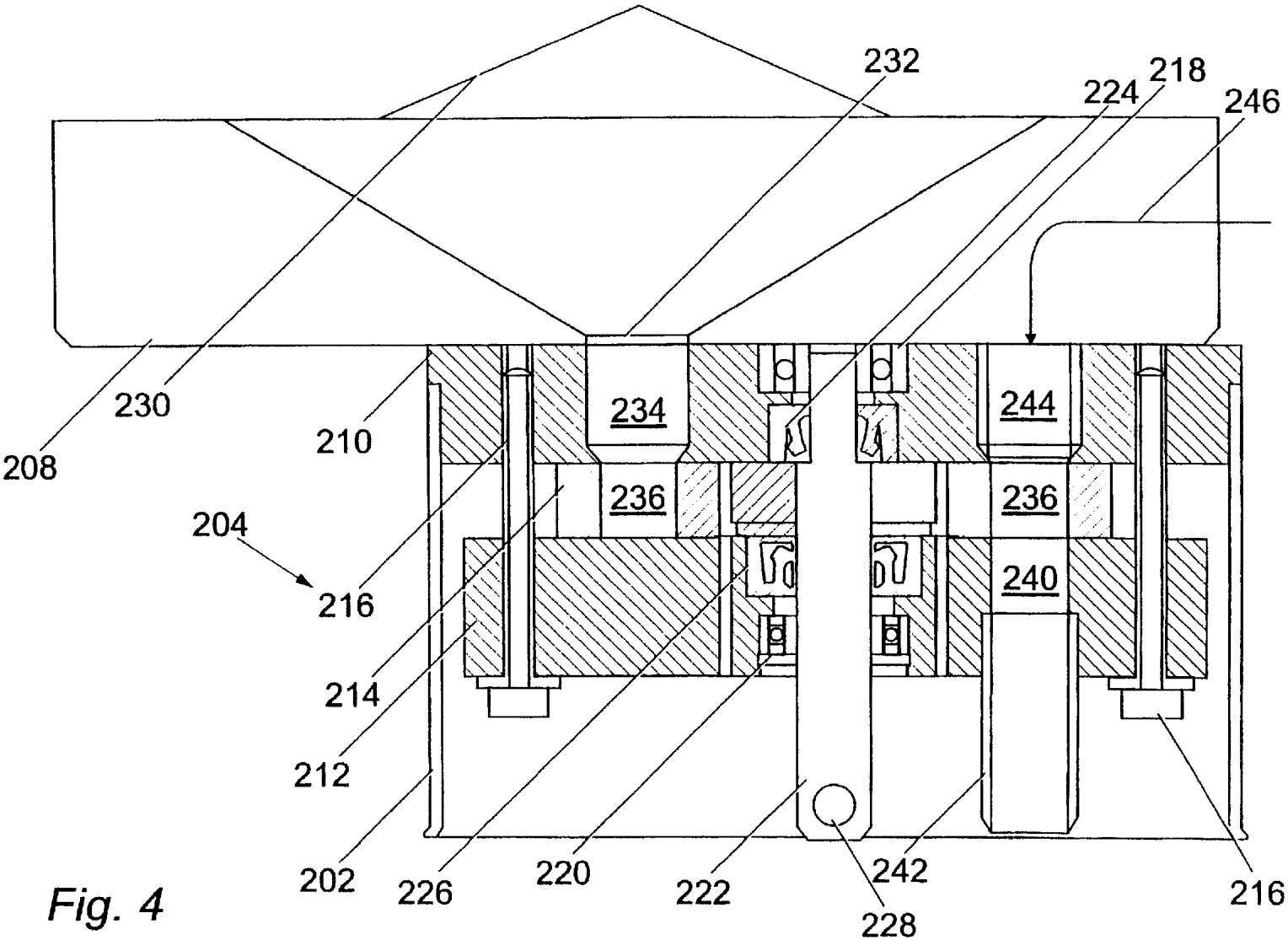
FIG. 4 is a sectional elevation, to a much enlarged scale, of a dispensing unit forming part of the arrangement of FIG. 1.
Figure 5A:
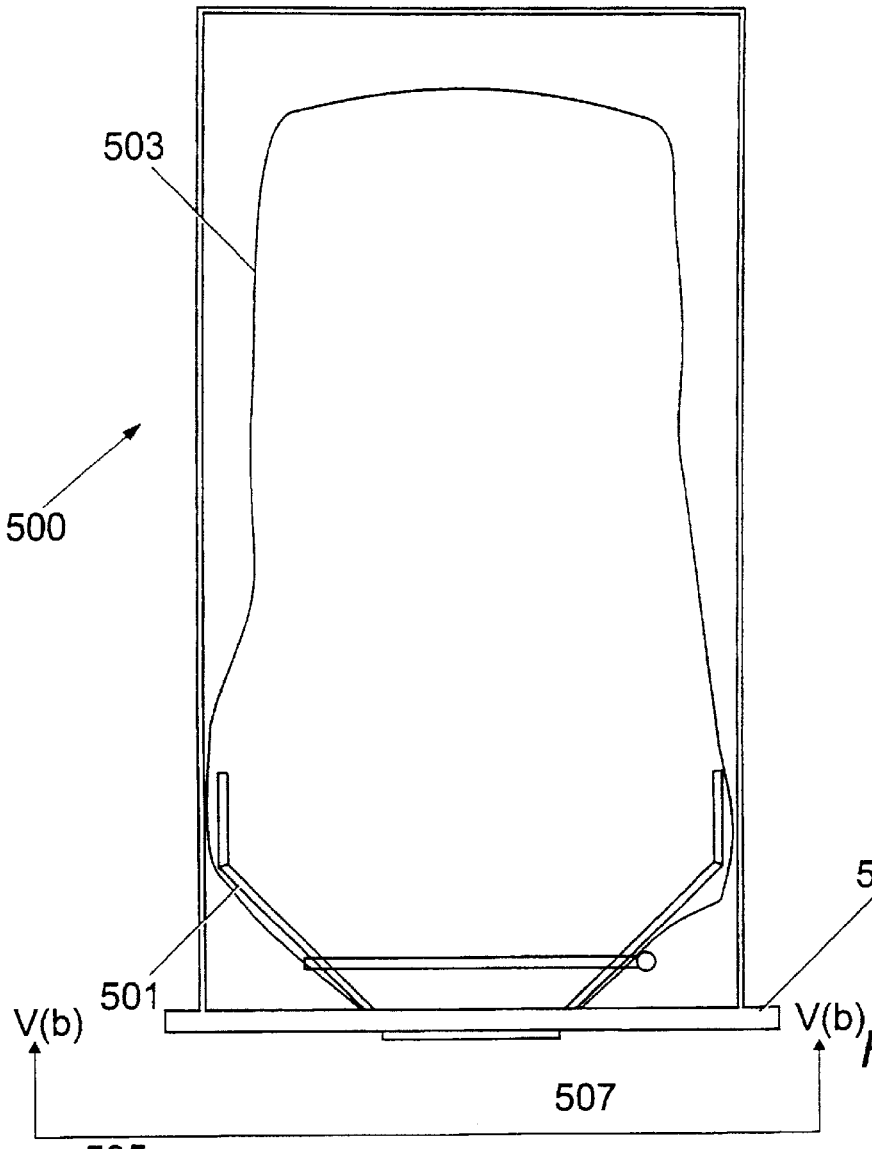
FIGS. 5(*a*) and 5(*b*) are a cross-sectional side view and end view, respectively of an aggregate container for use with the present invention.
Figure 5B:
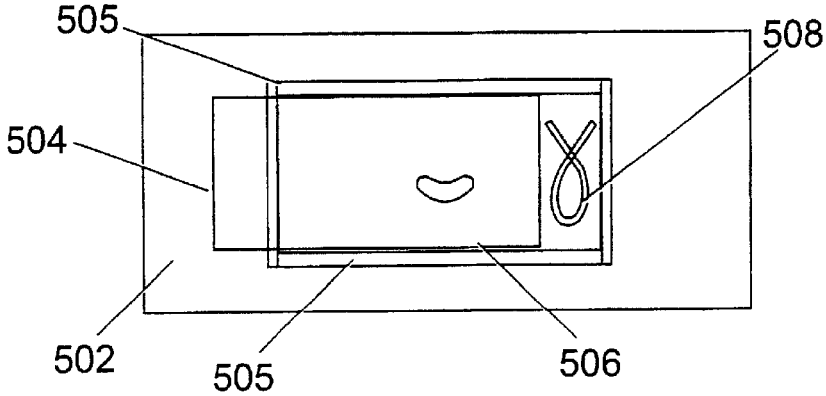
Figure 8:
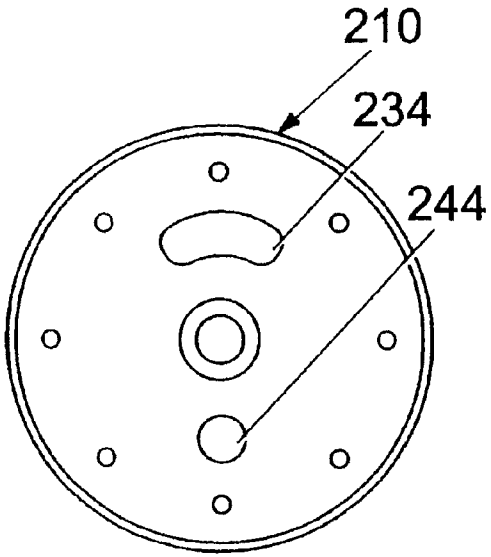
FIG. 8 is a plan view of the under (left) side of the upper plate of FIG. 6.
Figure 6:
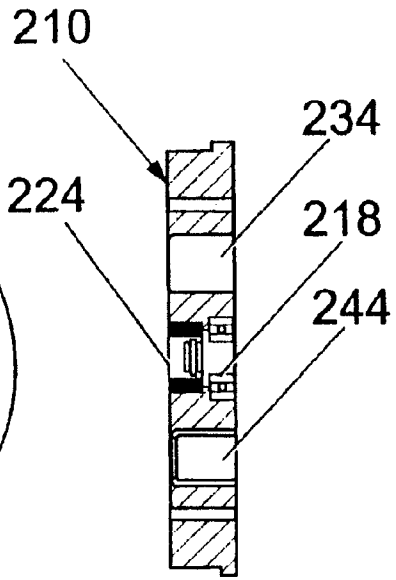
FIG. 6 is a diametral section (to an enlarged scale) of an upper plate forming part of a dispensing unit of the supply and control system of FIG. 1.
Figure 7:
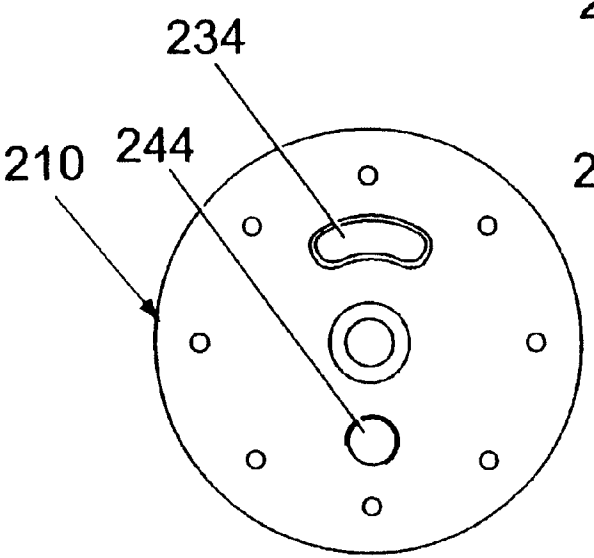
FIG. 7 is a plan view of the upper (right) side of the upper plate of FIG. 6.
Figure 10:
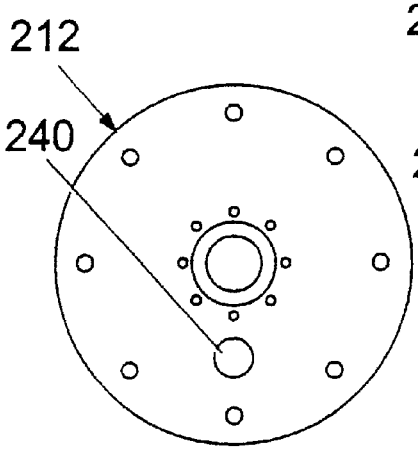
FIG. 10 is a plan view of the upper (right) side of the lower plate of FIG. 9.
Figure 9:
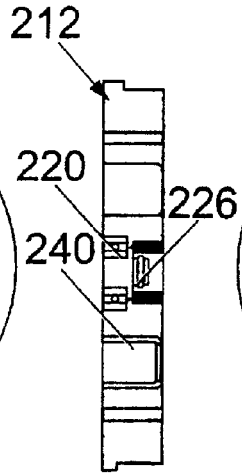
FIG. 9 is a diametral section (to an enlarged scale) of a lower plate forming part of the dispensing unit of the supply and control system of FIG. 1.
Figure 11:
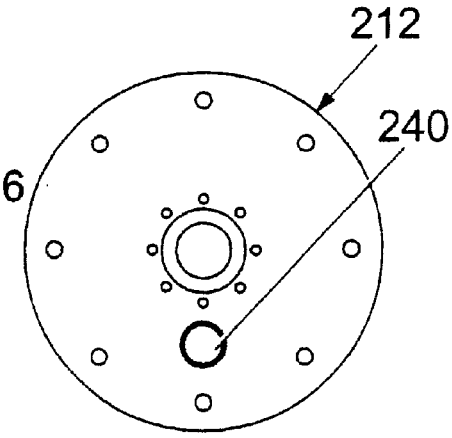
FIG. 11 is a plan view of the under (left) side of the lower plate of FIG. 9.

Instead of the permanent container 206 shown in FIGS. 1–4, the system 200 may use a replaceable container 500, shown in FIGS. 5(*a*) and 5(*b*), which may be supplied as a consumable item. This particular embodiment of the container 500 is fabricated from strong cardboard or plastic and is formed in the shape of a cuboid. At the base of the container 500 is a tapered funnel section 501 and a flanged plate 502. Fixed over the funnel section 501 is an inner bag 503 that holds the aggregate. It will be appreciated that although the funnel section 501 and plate 502 are referred to as being at the base of the container 500, when the container is being filled with aggregate, the container will be inverted from what is shown in FIG. 5(*a*). The flanged plate 502 is the interface between the container 500 and the dispensing unit 204.

FIG. 5(*b*) shows the outlet and inlet arrangement of the container 500. In order to receive this particular container 500, the dispensing unit 204 would have to be fitted with an adapter (not shown). When the container 500 is fitted to the dispensing unit 204, the adapter acts upon a spring-loaded drawer 504 that runs between a pair of rail members 505. The drawer 504 slides between the rails 505 until an aperture 506 contained in the drawer aligns with both the opening 507 of the container 500 and the through hole 234 of the dispensing unit 204, thus allowing the aggregate to enter the dispensing unit 204. When the container 500 is removed from the dispensing unit 204, the spring 508 will push the drawer 504 back to its closed position, thereby preventing aggregate from leaving the container 500. In other ways the replaceable container 500 functions in the same way as the permanent container 206.

The upper plate 210 (see FIGS. 4 and 6–8) has an off-centre through hole 234 (ie a hole which is radially displaced from the centre of the plate 210 and which extends between opposite major faces of the plate 210), the hole 234 being somewhat extended in a circumferential direction to assist in efficient filling of rotor cavities (as will be explained subsequently). The dispensing unit 204 is secured to the container neck flange 208 such that the hole 234 in the upper plate 210 is directly under the container outlet 232. Since the outlet 232 is central in the lower face of the flange 208, whereas the hole 234 is offset from the centre of the plate 210, alignment of the hole 234 with the outlet 232 requires that the plate 210, and ultimately the entire dispensing unit 204, be offset from the centre of the neck flange 208.

Figure 13:
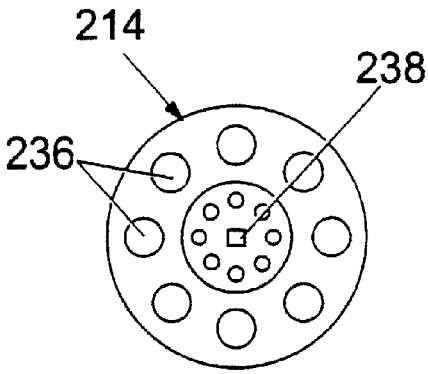
FIG. 13 is a plan view of the rotor disc of FIG. 12.
Figure 12:
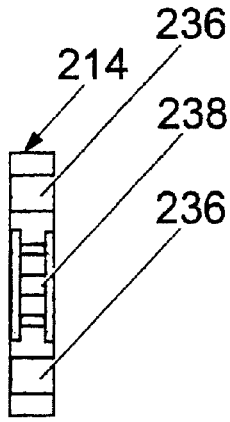
FIG. 12 is a diametral section (to an enlarged scale) of a rotor disc forming part of the dispensing unit of the supply and control system of FIG. 1.

Referring to FIGS. 4, 12, and 13, the rotor disc 214 of the dispensing unit 204 has eight equi-angularly spaced through holes 236, each at the same radial displacement from the centre of the disc 214 (which is also identical to the radial displacement of the hole 234 from the centre of the upper plate 210). A hole 238 at the centre of the rotor disc 214 is square in cross-section in order to key the rotor disc 214 to the shaft 222. As the rotor disc 214 is rotated between the plates 210 and 212 by continuous rotation of the shaft 222 (driven by the afore-mentioned air motor through the double-reduction belt drive 134, the pulley 132, the shaft 120, the shaft coupling socket 136, the shaft coupling 228, the shaft 222, and the square hole 238), successive ones of the holes 236 in the rotor disc 214 come under the hole 234 in the upper plate 210 and are thereupon filled by particulate material in the container 206 falling under gravity down the cone 230 and through the container outlet 232. The circumferential extension of the hole 234 extends the duration of the exposure of the full cross-section of each of the moving rotor holes 236 to descending particulate material, and hence improves the efficiency of filling of the rotor cavities constituted by the holes 236. Gravitational filling of the rotor cavities 236 with descending particulate material may be assisted by pneumatically pressurising the interior of the container 206 above the back-pressure within empty ones of the rotor cavities 236 as they are rotated to come under the hole 234.

Referring to FIGS. 4 and 9–11, the lower fixed plate 212 of the dispensing unit 204 has a through hole 240, the lower end of which is fitted with an outlet spout 242. The hole 240 is diametrically opposite the hole 234. As the rotor disc 214 continues to rotate, the rotor holes or cavities 236 which were previously filled under the hole 234 come over the hole 240, and the cargo of particulate material drops out the rotor cavity 236 and into the hole 240. Emptying of each of the filled rotor cavities 236 in turn is assisted by providing the fixed upper plate 210 with a through hole 244 directly above the hole 240 in the lower fixed plate 212, the hole 244 being provided with an air supply 246 (depicted schematically) which purges each of the rotor cavities 236 in turn with an air blast.

Reverting to FIGS. 2 and 4, it will be seen that the outlet spout 242 depending from the dispensing unit 204 plugs in to an inlet tube 138 projecting through the top of the mixing chamber 102. The lower end of the outlet spout 242 is sealed in an airtight manner to the upper end of the inlet tube 138 by means of an elastomeric sleeve 140 lining the inside of the upper end of the inlet tube 138, the bore of the sleeve 140 being dimensioned for the spout 242 to have a plug fit in it.

The volume of particulate material metered and dispensed by the dispensing unit 204 can be varied in a number of ways:

(1) the volume per unit of time can be varied (without any other changes) by varying the rotational speed of the rotor disc 214, ie the greater the number of revolutions per minute of the rotor disc 214, the greater the volume of particulate material passed through the dispensing unit 204 (assuming no significant variation, with varying rotor speed, in the volumetric efficiency of filling and emptying of the rotor cavities 236).

(2) the volume per revolution of the rotor disc 214 can be varied by varying the number of holes or cavities (without changing the volume per cavity).

(3) the volume per revolution of the rotor disc 214 can be varied (without varying the number of holes or cavities) by varying the volume of each cavity. This can be done by varying the diameter or cross-sectional area of each hole, or by varying the length of each hole (ie by varying the thickness of the rotor disc), or by suitably varying both length and diameter. While the volume per cavity in a rotor disc of unchanged thickness could be altered by inserting an appropriately dimensioned sleeve in each hole, it may be simpler to exchange one rotor disc for another, each rotor in the interchangeable series having cavity dimensions and numbers selected to give a different total cavity volume per revolution.

While the dispensed volume can be varied by adopting any one of the above procedures, two or more of these procedures could be adopted simultaneously.

Since there are so many variables associated with abrasive blasting, (eg volumetric air flow rate, air mass flow rate, volumetric abrasive flow rate, abrasive mass flow rate, air/abrasive ratio, and nozzle exit velocity), optimisation of abrasive blasting performance requires suitable control of operational parameters. Operator setting of controls requires skill and diligence, whereas the present invention avoids reliance on operators by storing parameter settings on the supply and control unit 200 at the time that it is filled with particulate material at a depot, and causing these parameter settings to be imposed on the abrasive blasting system 100 when the pre-filled and pre-set supply and control unit is fitted. This is schematically depicted in FIGS. 1 and 2, to which reference will now be made.

An operational parameter storage and transmission system 290 is mounted on the container neck flange 208, adjacent the coupling 202 around the dispensing unit 204. The system 290 stores operational parameters in an encoded form in an internal memory, and an internal transmitter transmits the encoded parameter settings to the abrasive blasting system 100 at an appropriate time, eg in the course of attaching the supply and control unit 200 to the abrasive blasting system 100, or immediately afterwards, or immediately prior to (or during) use of the abrasive blasting system 100. At the depot where the container 206 is loaded with a particulate material selected for a particular type of task, optimum operational parameters are simultaneously encoded into the internal memory of the system 290.

An operational parameter reception system 190 is mounted on top of the mixing chamber 102 adjacent the coupling 118 such that the reception system 190 will be suitably adjacent to or in contact with the storage and transmission system 290 when the couplings 118 and 202 are fully mated. The reception system 190 includes an internal receiver for receiving a transmission 300 of encoded operational parameters from the storage and transmission system 290. The reception system 190 also includes internal means for storing, decoding, and applying operational parameter settings to the various controls of the abrasive blasting system 100 (to be detailed below with reference to FIG. 20). The transmission 300 may be of any suitable form, eg an encoded radio, optical, or other electromagnetic signal transmission, or (where the systems 190 and 290 are in direct physical contact) by encoded electric currents passed through an array of mated conductive contacts. Alternatively, the transmission may be by means of direct electrical connection of a connecting cable, plug and socket (not shown).

The operational parameter storage and transmission system 290 and the operational parameter reception system 190 can each take many different forms (provided, of course, that they are mutually compatible). By way of example, the storage and transmission system 290 can comprise an EE-PROM (electrically erasable programmable read-only semiconductor memory) pre-loaded with encoded operational parameters, and the reception system 190 can comprise any compatible form of EE-PROM-reader. Alternatively, the storage and transmission system 290 can comprise a bar code or the like, and the reception system 190 can comprise any suitable form of bar code reader. As a further alternative, the reception system 190 can comprise an array of spring-biassed pneumatic valves or electric switches, and the storage and transmission system 290 can comprise a compatible array of valve/switch operators individually selectively arrangeable into a valve/switch-operating configuration, or into a valve/switch non-operating configuration. As a still further alternative, the reception system 190 can comprise an array of pairs of mutually isolated electrical contacts, and the storage and transmission system 290 can comprise a compatible array wherein contact bridges can be selectively deployed or omitted such as to bridge, or to leave mutually unconnected, respective pairs of contacts in the reception system 190 when the supply and control system 200 is operationally mated with the abrasive blasting system 100. The storage-transmission/reception systems 290+190 could be adopted from known film cassette/camera combinations wherein use of a particular film cassette in a given camera causes appropriate variations in the settings of that camera.

Figure 14:
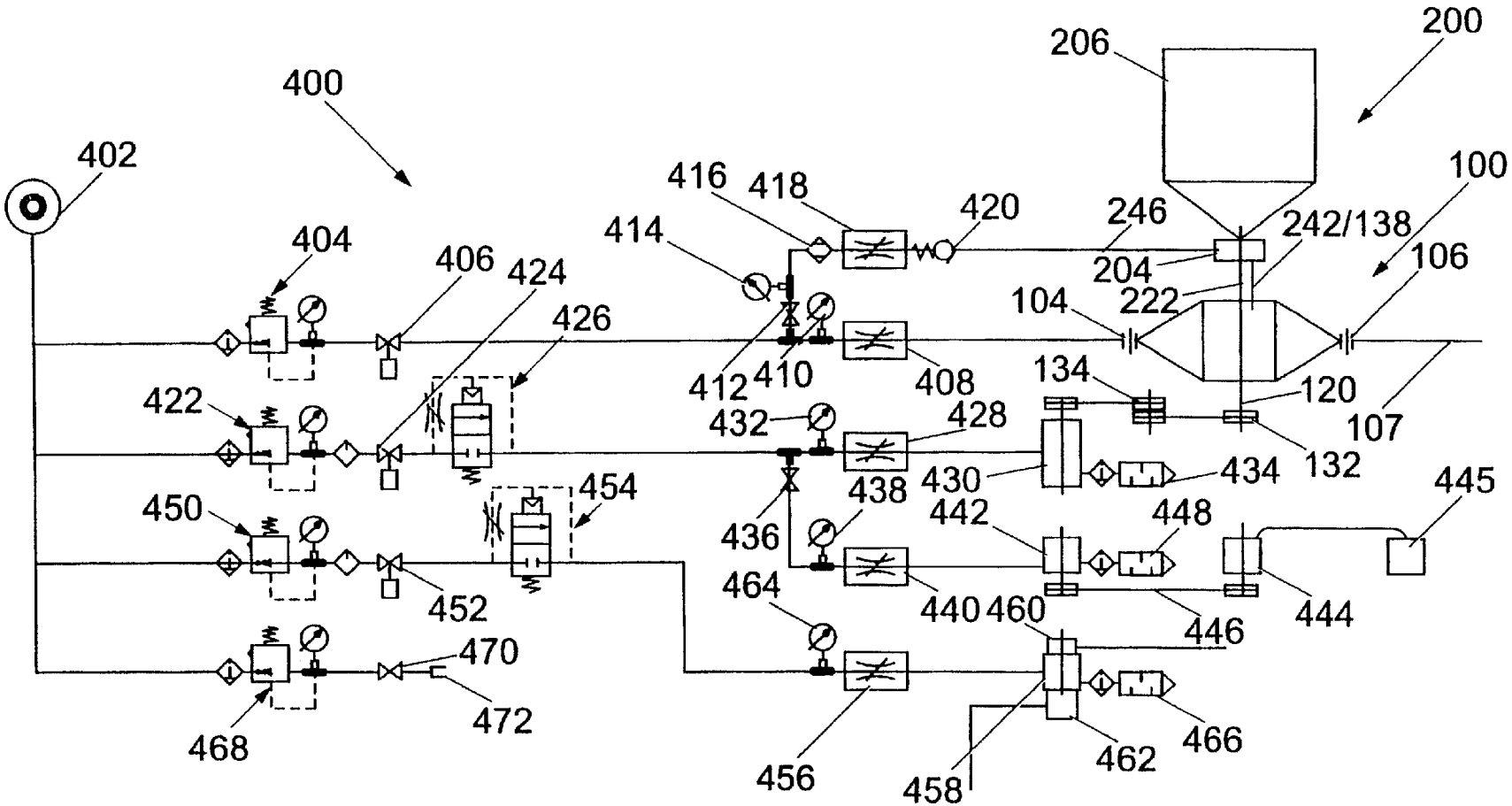
FIG. 14 is a pneumatic circuit diagram for operation of the arrangement of FIG. 1.

Referring now to FIG. 14, this schematically depicts a mainly pneumatic supply and control system 400 including various controls of the operational parameters. The pneumatic system 400 comprises a compressed air supply 402 which feeds several air-consuming sub-systems (detailed below).

A transport air and purge air sub-system of the pneumatic system 400 comprises a pressure regulator 404 and an isolating valve 406 feeding through an adjustable consumption-limiting throttle 408 to the inlet connector 104 as a supply of transport air for mixing with metered particulate material inside the mixing chamber 102 and delivery of the air/abrasive mixture through the outlet hose 107 to the nozzle (not shown) by which the operator blasts the surface being cleaned or otherwise treated. A pressure gauge 410 connected immediately upstream of the throttle 408 monitors the pressure of delivered transport air.

Purge air is branched from the transport air sub-system between the valve 406 and the gauge 410 by way of an isolating valve 412 and a further pressure gauge 414 to be passed through an air drier 416, an adjustable consumption-limiting throttle valve 418, and a non-return valve 420 for delivery to the dispensing unit 204 via the rotor cavity purge line 246.

A motor supply sub-system of the pneumatic system 400 comprises a pressure regulator 422, an isolating valve 424, and a delayed-action self-switching valve 426 feeding through an adjustable consumption-limiting throttle 428 to a pneumatic motor 430 which drives the rotor disc 214 of the dispensing unit 204 by way of the double-reduction pulley drive 134 and the shaft 120. A pressure gauge 432 connected immediately upstream of the throttle 428 monitors the pressure of delivered motor air. The rotor drive motor 430 exhausts to ambient atmosphere through a silencer 434.

Air for supply to another motor is branched from the supply for the rotor drive motor 430 between the valve 426 and the gauge 432 by way of an isolating valve 436 and a further pressure gauge 438 to be passed through an adjustable consumption-limiting throttle 440 for delivery to a pneumatic motor 442 which drives a dynamo 444 through a belt drive 446. The output of the dynamo 444 is at a very low voltage which is intrinsically safe, ie unable to cause sparks, and serves to power the operational parameter reception system 190 together with the storage and transmission system 290 as well as charging a back-up battery 445. The dynamo drive motor 442 exhausts to ambient atmosphere through a silencer 448.

A further motor supply sub-system comprises a pressure regulator 450, an isolating valve 452, and a delayed-action self-switching valve 454 feeding through an adjustable consumption-limiting throttle 456 to a pneumatic motor 458 which drives first and second water pumps 460, 462 for the supply of dust-suppressing sprays, debris flushing, and general washing duties. A pressure gauge 464 connected immediately upstream of the throttle 456 monitors the pressure of delivered air. The water pump drive motor 458 exhausts to ambient atmosphere through a silencer 466.

An air-blast cleaning/flushing sub-system of the pneumatic system 400 comprises a pressure regulator 468 and an isolating valve 470 feeding a hose 472 for the supply of a jet of clean air which can be used for dry cleaning of equipment, articles, etc, and for flushing unwanted accumulations of abrasives, debris, and the like.

The pneumatic system 400 may also be arranged to supply dust-free breathing air for the operator.

Those parts of the pneumatic control system 400 which are adjustable (eg a range of settings) or which are otherwise controllable (eg switched off or on) are set in respect of operational parameters by settings initially stored in the transmission system 290 and subsequently transmitted to the reception system 190. The predetermined operational parameters may be exact values, or they may be ranges of values within which the operator has discretion to select a particular value for operation.

The blasting nozzle through which air/abrasive mixture is delivered from the hose 107 (usually but not necessarily manually positioned by the operator) against a surface to be treated by the abrasive jet may incorporate separation sensing means to monitor the separation of the nozzle from the surface with the intention of warning the operator and/or temporarily suspending the blast in the event that the nozzle is too close to or too far from the surface.

Operator controls on or adjacent the nozzle may deliver command signals (eg pneumatic or electric signals) to the blasting system 100, such as start/stop signals, and variations of such operational parameters as are permitted to be varied within the predetermined settings programmed into the reception system 190.

Other modifications and variations can be adopted without departing from the scope of the invention as defined in the following claims.

What is claimed is:

1. A supply and control system for holding a particulate material and to be operatively mated with an abrasive blasting apparatus utilising particulate material initially held in the supply and control system which system comprises: container means for holding the particulate material, dispensing means for controllably dispensing particulate material from the container means, coupling means for coupling the supply and control system to the abrasive blasting apparatus, and abrasive blasting operational parameter setting storage and transmission means for storing predetermined operational abrasive blasting parameter settings for the abrasive blasting apparatus and for transmitting these stored abrasive blasting operational parameter settings to a reception system of the abrasive blasting apparatus when the supply and control system is coupled thereto by said coupling means, wherein the dispensing means comprises a rotor obturating an outlet of the container means, the rotor comprising at least one cavity intermittently brought into communication with the outlet of the container means by rotation of the rotor, the dispensing means further comprising a transfer port, wherein the at least one cavity intermittently comes into communication with the transfer port.

2. A supply and control system as claimed in claim 1, wherein the dispensing means further comprises a purge port aligned with the transfer port whereby, when the rotor cavity or a given one of a plurality of cavities in the rotor becomes aligned with the transfer port, the purge port and the transfer port are in fluid communication.

3. A supply and control system as claimed in claim 2, wherein the rotor further comprises a rotational coupling by which the rotor may be rotationally coupled to a rotor drive means forming part of the apparatus.

4. A supply and control system as claimed in claim 3, wherein the rotor is formed as a disc having a plurality of through cavities substantially equi-angularly disposed around the rotational axis of the disc.

5. A supply and control system as claimed in claim 4, wherein the rotor is interchangeable with one or more other rotors having different cavity volumes and/or different numbers of cavities.

6. A supply and control system as claimed in claim 3, wherein the rotor is interchangeable with one or more other rotors having different cavity volumes and/or different numbers of cavities.

7. A supply and control system as claimed in claim 2, wherein the rotor is formed as a disc having a plurality of through cavities substantially equi-angularly disposed around the rotational axis of the disc.

8. A supply and control system as claimed in claim 7, wherein the rotor is interchangeable with one or more other rotors having different cavity volumes and/or different numbers of cavities.

9. A supply and control system as claimed in claim 2, wherein the rotor is interchangeable with one or more other rotors having different cavity volumes and/or different numbers of cavities.

10. A supply and control system as claimed in claim 1, wherein the rotor is formed as a disc having a plurality of through cavities substantially equi-angularly disposed around the rotational axis of the disc.

11. A supply and control system as claimed in claim 10, wherein the rotor is interchangeable with one or more other rotors having different cavity volumes and/or different numbers of cavities.

12. A supply and control system as claimed in claim 1, wherein the rotor is interchangeable with one or more other rotors having different cavity volumes and/or different numbers of cavities.

13. A supply and control system for holding a particulate material and to be operatively mated with an abrasive blasting apparatus utilising particulate material initially held in the supply and control system which system comprises: container means for the particulate material, dispensing means for controllably dispensing particulate material from the container means, coupling means for coupling the supply and control system to the abrasive blasting apparatus, and abrasive blasting operational parameter setting storage and transmission means for storing predetermined operational abrasive blasting parameter settings for the abrasive blasting apparatus and for transmitting these stored abrasive blasting operational parameter settings to a reception system of the abrasive blasting apparatus when the supply and control system is coupled thereto by said coupling means, wherein said container means comprises a substantially rigid outer structure having an adjustable door means therein, and a bag means inside said outer structure, said bag means being open at one end where the open end is adjacent said door means.

14. A supply and control system as claimed in claim 13, wherein said door means comprises a slidable plate member having an aperture therein, said plate member being biased in a first position so that said aperture is closed, and said plate member moving to a second position in which said aperture is open when said container means is coupled to said dispensing means.

15. A supply and control system as claimed in claim 14, wherein said container means comprises a substantially rigid outer structure having an adjustable door means therein, and a bag means inside said outer structure, said bag means being open at one end where the open end is adjacent said door means.

16. A supply and control system as claimed in claim 13, wherein said container means is disposable.

17. A supply and control system for holding a particulate material and for co-operating with an apparatus utilising particulate material initially held in the supply and control system, the supply and control system comprising:

container means for holding the particulate material;

dispensing means for controllably dispensing particulate material from the container means;

coupling means for coupling the supply and control system to the apparatus; and operational parameter storage and transmission means for storing predetermined operational parameters for the apparatus and for transmitting these stored operational parameters to the apparatus when the supply and control system is coupled thereto;

wherein said container means comprises a substantially rigid outer structure having an adjustable door means therein, and a bag means inside said outer structure, said bag means being open at one end where the open end is adjacent said door means.

18. A supply and control system as claimed in claim 17, wherein said door means comprises a slidable plate member having an aperture therein, said plate member being biased in a first position so that said aperture is closed, and said plate member moving to a second position in which said aperture is open when said container means is coupled to said dispensing means.

19. A supply and control system as claimed in claim 18, wherein said container means comprises a substantially rigid outer structure having an adjustable door means therein, and a bag means inside said outer structure, said bag means being open at one end where the open end is adjacent said door means.

20. A supply and control system as claimed in claim 17, wherein said container means is disposable.

* * * * *